US007151510B2

(12) United States Patent
Whang et al.

(10) Patent No.: US 7,151,510 B2
(45) Date of Patent: Dec. 19, 2006

(54) METHOD OF DRIVING PLASMA DISPLAY PANEL

(75) Inventors: Ki-Woong Whang, Seoul (KR); Jin-Ho Yang, Cheju-si (KR); Woo-Joon Jung, Seongnam-si (KR)

(73) Assignee: Seoul National University Industry Foundation, Seoul (KR)

( * ) Notice: Subject to any disclaimer, the term of this patent is extended or adjusted under 35 U.S.C. 154(b) by 552 days.

(21) Appl. No.: 10/727,148

(22) Filed: Dec. 3, 2003

(65) Prior Publication Data

US 2005/0057443 A1 Mar. 17, 2005

(30) Foreign Application Priority Data

Dec. 4, 2002 (KR) ..... 10-2002-0076712
Nov. 25, 2003 (KR) ..... 10-2003-0084142

(51) Int. Cl.
*G09G 3/28* (2006.01)

(52) U.S. Cl. ..... 345/66; 345/60; 315/169.4

(58) Field of Classification Search ..... 345/60, 345/62, 63–68, 77–78, 80; 315/169.4
See application file for complete search history.

(56) References Cited

U.S. PATENT DOCUMENTS 5,745,086 A 4/1998 Weber
6,781,564 B1 * 8/2004 Onozawa et al. ..... 345/60
2004/0212558 A1 * 10/2004 Son et al. ..... 345/60

OTHER PUBLICATIONS

K. Yoshikawa et al., "A Full Color AC Plasma Display With 256 Gray Scale", Japan Display, 1992, pp. 605-608.
Larry F. Weber, "Plasma Display Device Challenges", Asia Display, 1998, pp. 15-27.

* cited by examiner

*Primary Examiner*—Richard Hjerpe
*Assistant Examiner*—Mansour M. Said
(74) *Attorney, Agent, or Firm*—The Webb Law Firm

(57) ABSTRACT

The present invention is to provide a method and apparatus for driving an AC PDP, where background luminance is reduced and the time required for a reset period is shortened while the stability and an address margin are sufficiently maintained, thus improving reset performance. The present invention provides a method of driving an Alternating Current (AC) Plasma Display Panel (PDP) comprising the steps of: applying a drive signal including a plurality of successive short pulses during the reset period; addressing at least a part of the discharge cells by applying data pulses to at least a part of said electrodes to enable selective discharge of said discharge cells according to image data during the address period; wherein, during the reset period, the plurality of short pulses form a plurality of discharges each duration of which is limited; and wherein a standardized wall charge is formed in each of the discharge cells due to the plurality of discharges so that the selective discharge is easily generated by application of data pulses during the address period.

18 Claims, 14 Drawing Sheets

MSP(Multiple Short Pulses)

SMSP(Stepwise Multiple Short Pulses)

RMSP(Ramp biased Multiple Short Pulses)

METHOD OF DRIVING PLASMA DISPLAY PANEL

BACKGROUND OF THE INVENTION

1. Field of the Invention

The present invention relates generally to a method and apparatus for driving an alternating current plasma display panel (AC PDP), and, more particularly, to a method and apparatus for driving an alternating current plasma display panel, whereby image contrast is improved by reducing the emission of background light and an uniform and stable wall charge distribution is established over the entire panel though a relatively short reset time is used, thus allowing a subsequent data write operation to be easily performed.

2. Description of the Related Art

Various structures of Alternating Current (AC) Plasma Display Panels (PDPs) exist. Well-known and widely used ones of these structures are somewhat similar. A typical structure of AC PDPs is illustrated in FIG. 1. As illustrated in FIG. 1, an AC PDP includes an upper panel and a lower panel. The upper panel includes a glass substrate 51, a plurality of scan electrodes 69 and a plurality of sustain electrodes 79 arranged on the lower surface of the upper substrate to be parallel with one another, a dielectric layer 54 formed on the lower surface of the upper substrate on which the scan and sustain electrodes 69 and 79 have been formed, and a protective layer 55 formed on the dielectric layer 54. The lower substrate includes a back substrate 58, a plurality of addressing electrodes 89 arranged on the back substrate 58 to be perpendicular to the scanning and discharge sustain electrodes 69 and 79, a plurality of barrier walls 56 arranged to be parallel with the addressing electrodes 89 to partition cells from one another, and a phosphor layer 57. Discharge spaces between the upper panel and the lower panel are filled with a gas that can be ionized. A plurality of cells are formed around the discharge spaces where the scan electrodes 69, the discharge sustain electrodes 79 being parallel to the scan electrode 79 and the addressing electrodes 89 running in a direction intersecting the scan electrodes and the discharge sustain electrodes. Every three types of cells exhibiting red, green and blue colors, respectively, form a single pixel to provide various colors.

Voltages actually applied to the discharge spaces may be different from voltages applied to the electrodes due to wall voltages resulting from wall charges. Fundamental voltages concerned with the operations of the PDP to be described below are defined as follows. The value obtained by adding an externally applied voltage between the scan and the sustain electrodes and a wall voltage between the scan and the sustain electrodes due to the accumulated wall charge is defined as a voltage across the discharge space 75, while the value obtained by adding an externally applied voltage between the scan and the address electrodes and a wall voltage between the scan and the address electrodes due to the accumulated wall charge is defined as a voltage difference between scan and address electrodes.

A conventional basic method of driving the panels 50 is described below. A write discharge is generated by selectively applying an address voltage exceeding the firing voltage to a discharge space defined by the row electrodes 69 and 79 and column electrode 89 of a cell selected in accordance with image data. Thereafter, an image is represented by generating sustain discharges in such a way as to alternately apply sustain voltages to the scan electrodes 69 and the sustain electrodes 79 to such an extent that the sustain discharges are generated in cells where the write discharges have been generated by the application of the address voltages but the sustain discharges are not generated in cells where the write discharges have not been generated. This technique utilizes "a memory effect" resulting from a wall voltage, which is the unique characteristic of an AC PDP. The voltage to be applied to the discharge space is blocked by the wall voltages generated by the accumulation of electrons and ions on the dielectric layer 54 and the protective layer 55. These accumulated electrons and ions remain till a next discharge, and a voltage (that is, a wall voltage) resulting from these accumulated electrons and ions is added to a currently applied pulse voltage, so a high voltage is applied to the discharge space to facilitate a discharge. This action of the wall charge is called the memory effect.

Accordingly, in order to reliably drive the AC PDP, it is important to control the amounts of the accumulated wall charges to be constant during reset operation. Additionally, data write (address) and discharge sustain operations are stably accomplished by controlling a certain amount of wall charge desired by a designer to be accumulated during the reset period, regardless of the generation of discharge at the corresponding cell during the previous sustain period (that is, without the influence of the memory effect resulting from wall charges accumulated during the previous sustain period).

For a conventional reset method for reliably driving an AC PDP, there is a method of controlling wall charge status over an entire screen by carrying out an erase discharge, a write discharge and another erase discharge over an entire screen, which was first introduced in Yoshikawa el al., "A Full Color AC Plasma Display with 256 Gray Scale," Japan Display, 1992, pp 605~608. Thereafter, it was disclosed that a reset operation using a ramp-shaped waveform can achieve the stabilization of operation as well as the improvement of image contrast, in the thesis of Larry F. Weber, "Plasma Display Device Challenges," Asia Display, 1998, pp 15–27, and the technique of the thesis was issued as U.S. Pat. No. 5,745,086 entitled "Plasma Panel Exhibiting Enhanced Contrast."

In the driving method proposed by Yoshikawa et al. 8 sub-fields having different brightness are provided in one Television (TV) frame (generally, 16.7 ms) to represent 256 gray scale levels and each of the 8 sub-fields is divided into an address period and a sustain period. That is, the 8 sub-fields have the relative lengths of sustain periods corresponding to $2^0$, $2^1$, $2^2$, $2^3$, $2^4$, $2^5$, $2^6$ and $2^7$, and 256 ($=2^8$) gray scale levels can be represented by the combination of the sub-fields. In the sustain period, discharges are generated in only discharge spaces turned on during the address period by alternately applying sustain pulses to the scan and sustain electrodes 69 and 79, so that luminances are implemented to be proportional to the number of the sustain pulses. A voltage of a magnitude, which is sufficient to generate a sustain discharge in a discharge space turned ON during the address period and is insufficient to generate a sustain discharge in a discharge space turned OFF during the address period, is used as a sustain voltage Vs.

FIG. 3 shows an example of driving waveforms employed during a single sub-field shown in FIG. 2. In order to write data while sequentially selecting rows at step 4 of an address period in a sub-field regardless of whether the sustain discharge were turned on or not in a previous field, preparatory steps, that is, steps 1 to 3 (having an identical function with a reset period of another prior art shown in FIG. 4), are required. At the beginning stage of the step 2 which follows the step 1, a strong discharge is formed due to a high voltage pulse (write pulse) applied between the scan electrode 69 (Y electrode) and the sustain electrode 79 (X electrode), so that a wall voltage of a similar magnitude with the write pulse is formed between the electrodes 69 and 79, as a result of wall charge accumulation in the discharge cell. At the end of the step 2, because the externally applied pulse voltage falls to a reference voltage, only the wall voltage is remained in the discharge space. Therefore, a self-erasing discharge due to the wall voltage is formed and the wall voltage disappears by the wall charge erasing effect of the self-erasing discharge. Accordingly, the address period is initiated in condition that the wall voltages in all of the discharge cells are annihilated to 0 V. After that, in the step 4, address discharges are formed in each of the rows over the panel by applying data pulses $V_A$ to the address electrodes 89, the data pulses synchronized with scan pulses which are applied to the scan electrodes.

An object that Yoshikawa et al. attempted to achieve through the provision of the steps 1 to 3 is to overcome problems that can be caused by the various distributions of wall charges over the discharge spaces distributed on the panel. In Larry F. Weber's patent, the period of the steps is called a set-up period (corresponding to a reset period 10 in an embodiment of the present invention) General requirements of the set-up period are as follows:

First, the set-up period must function to prime discharge spaces so as to perform reliable driving in selective address and sustain periods thereafter.

Second, the set-up period must uniformly establish a predetermined amount of wall voltage required for a stable operation in a given sub-field. The amount of wall voltage is determined according to a degree required to allow a selective write operation to be normally performed during the address period of each sub-field. A very important point is that a predetermined amount of wall voltage, which must be established during the set-up period of a given sub-field, must not be affected by the amount of wall voltage that remains from the previous sub-field. If predetermined amounts of wall voltages of some discharge cells are affected by the status of the previous sub-field, the distributions of wall voltages over discharge cells become uneven. As a result, the selective write operation or the sustain operation may be erroneously performed.

In conclusion, the driving for the reset period must be designed to assure stability. Additionally, to what extent the following requirements are achieved can be another criterion to evaluate performances of various driving methods used for the reset period.

First, a darkroom contrast ratio should be considered. There are two methods for improving the darkroom contrast ratio, that is, a method of increasing maximum brightness by improving discharge efficiency and luminance, increasing the number of sustain pulses, etc. and a method of reducing emission which is not related to the luminance level corresponding to the image data, that is, "background luminance". If the emission during a reset period, which has no relation with the level of the image data, is reduced, "background luminance" is decreased, so that the darkroom contrast ratio can be improved.

Second, the magnitude of usable voltage applied to the address electrode at the time of writing data after the reset period, that is, "an address margin," must be assured. The discharge characteristics of discharge spaces distributed over the screen of an AC PDP may deviate somewhat, and are significantly affected by circumstances around the discharge spaces. When "stability" is not only provided by establishing uniformity through the reset period so as to prevent the address discharges from being affected by such various circumstances, but addressing is also performed at a minimized address voltage, it can be stated that the address margin is sufficiently assured.

Third, the "time" required for the reset period must be reduced. In the driving method exemplified in FIG. 2 as a prior art, progressive scanning is performed 8 times for 480 (or more) lines to represent a single frame. For one basic method for correcting the error of the image representation of a PDP known as "dynamic false contour", there is used a method in which a single frame is composed of not 8 sub-fields but 10 to 12 sub-fields by increasing the number of sub-fields. Accordingly, if the time required for a single reset period is 300 us, the case where scanning is carried out 8 times requires 2.4 ms, and the case where scanning is carried out 12 times requires 3.6 ms. In these cases, the reset time occupies a considerable part of the 1/60 s, that is, 16.7 ms, given for a single frame. If the reset time is reduced to approximately 100 us, the reset time in a single frame becomes just 1.2 ms for the case where scanning is carried out 12 times. This fact allows a sub-field to be added or the sustain period to be lengthened for the period of 2.4 ms by which the reset period is reduced compared to the former lengthy reset period. The larger the number of sub-fields obtained by dividing a single frame, the more important the necessity for the reduction of the reset period become.

Of conventional voltage waveforms for the reset period, voltage waveforms used in the reset method proposed by Yoshikawa et al. are shown in FIG. 3. The waveforms of this method are referred to as "strong pulse reset waveforms." This method assures "stability" over all the discharge spaces of an entire screen by generating strong write discharges and self-erasing discharges between erase discharge pulses over the entire panel. In this method, the strong write discharge of step 2 is generated by the voltage higher than a sustain voltage, so that very strong light is emitted. Accordingly, since in this method, the background luminance level is considerably high, and this method is disadvantageous in that darkroom contrast ratio is low. It is known that this method assures a desirable address margin. It is also known that waveforms with lengthy time constants and low voltage are applied as the two erase pulses, which causes the time required for the reset period to be relatively long.

Of the conventional reset methods using various voltage waveforms, there is a reset method using a ramp waveform. In this reset method, wall voltage is controlled by the waveforms shown in FIG. 4. In this case, a ramp waveform having a constant slope is used to maintain a weak discharge mode that desirably controls the wall voltage. When the ramp waveform is limited to a considerably small slope (<10V/us), stability and address margin requirements are sufficiently fulfilled and the background luminance can be suppressed to a considerably low level compared to other conventional reset methods. However, in this case, the time required for the reset period must be lengthened.

As described above, stability is the basic requirement for the reset period, and it is important to achieve three other requirements, that is, a sufficiently low background luminance level, the assurance of an address margin and a short reset period, while achieving the stability of these three requirements, the assurance of the address margin is a requirement that must be fulfilled to a certain extent, and the reductions in background luminance and the reset period are requirements that are necessary to obtain improved image quality.

Further, the background luminance is concerned with the absolute intensity of a discharge occurring during the reset period. The background luminance is very important in that, as the background luminance decreases, the image contrast increases and clearer image quality can be obtained.

The reduction in the time required for a reset operation contributes to an improvement in the performance of a PDP in various aspects. The remaining time can be assigned to the sustain period by reducing the time required for the reset period, which results in the increase of brightness. Meanwhile, when the number of sub-fields is desired to be increased to 8 or more to overcome the dynamic false contour problem that impedes the implementation of motion images of a PDP, a much faster reset operation is required. Further, since much time must be assigned to the address period when the number of scan electrodes is increased according to an increase in the resolution of images to implement, a still faster reset operation is also required in this case.

SUMMARY OF THE INVENTION

Accordingly, the present invention has been made keeping in mind the above problems occurring in the prior art, and an object of the present invention is to provide a method and apparatus for driving an AC PDP, which can overcome disadvantages of conventional reset methods for AC PDPs in which stability is insufficient, background luminance is high and a long reset time is required, so that background luminance is reduced and the time required for a reset period is shortened while the stability and the address margin are sufficiently maintained, thus improving reset performance.

Another object of the present invention is to provide a method and apparatus for driving an AC PDP, where a reset operation is fulfilled by successively generating short discharges each duration of which is limited, so that each of the discharge is rapidly turned off before discharge current and light emission grow large, that is, in its initial stage, thus reducing the background luminance, shortening the reset time and providing the sufficient stability of driving.

In addition, the present invention is to provide a method and apparatus for driving an AC PDP, where a reset operation is fulfilled by using a drive signal including a plurality of successive short pulses to generate a plurality of discharges each duration of which is limited, wherein widths and periods of the short pulses are controllable so that amount of wall charge in the discharge cell is controllable and desired levels and uniform distribution of wall charges over the AC PDP can be obtained.

In order to accomplish the above object, the present invention provides a method of driving an Alternating Current (AC) Plasma Display Panel (PDP) including a plurality of discharge cells each of which has a scan electrode, a sustain electrode and an address electrode by applying drive signals to said electrodes, in which, in order to display image information on the AC PDP, one frame of the image information is divided into a plurality of sub-frames and each of the sub-frames includes a reset period, an address period and a sustain period, comprising the steps of: applying a drive signal including a plurality of successive short pulses during the reset period; addressing at least a part of said discharge cells by applying data pulses to at least a part of said electrodes to enable selective discharge of said discharge cells according to said image information during the address period; wherein, during the reset period, said plurality of short pulses form a plurality of discharges each duration of which is limited; and wherein a standardized wall charge is formed in each of the discharge cells due to the plurality of discharges so that the selective discharges are easily generated by the application of data pulses during the address period.

In accordance with another aspect of the present invention, the present invention provides a method of driving an Alternating Current (AC) Plasma Display Panel (PDP) including a plurality of discharge cells each of which has a scan electrode, a sustain electrode and an address electrode by applying drive signals to said electrodes, in which, in order to display image information on the AC PDP, one frame of the image information is divided into a plurality of sub-frames and each of the sub-frames includes a reset period, an address period and a sustain period, comprising the steps of: accumulating wall charge in the discharge cells during the reset period; erasing at least a part of the accumulated wall charge, during the reset period, by successively generating a plurality of discharges each duration of which is limited, so that stable data write operation is performed during the address period; and addressing at least a part of said discharge cells by applying data pulses to at least a part of said electrodes to enable selective discharge of said discharge cells according to said image information in the address period.

In accordance with yet another aspect of the present invention, the present invention provides a method of driving an Alternating Current (AC) Plasma Display Panel (PDP) including a plurality of discharge cells each of which has a scan electrode, a sustain electrode and an address electrode by applying drive signals to said electrodes, in which, in order to display image information on the AC PDP, one frame of the image information is divided into a plurality of sub-frames and each of the sub-frames includes a reset period, an address period and a sustain period, comprising the steps of: accumulating wall charge in the discharge cells, during the reset period, by successively generating a plurality of discharges each duration of which is limited, so that stable data write operation is performed during the address period; erasing at least a part of the accumulated wall charge during the reset period; and addressing at least a part of said discharge cells by applying data pulses to at least a part of said electrodes to enable selective discharge of said discharge cells according to said image information during the address period.

In accordance with still yet another aspect of the present invention, the present invention provides an Alternating Current (AC) Plasma Display Panel (PDP) including a plurality of discharge cells each of which has a scan electrode, a sustain electrode and an address electrode by applying drive signals to said electrodes, in which, in order to display image information on the AC PDP, one frame of the image information is divided into a plurality of sub-frames and each of the sub-frames includes a reset period, an address period and a sustain period, the AC plasma display panel further comprising: means for applying a drive signal including a plurality of successive short pulses during the reset period; means for addressing at least a part of said discharge cells by applying data pulses to at least a part of said electrodes to enable selective discharge of said discharge cells according to said image information during the address period; wherein, during the reset period, said plurality of short pulses form a plurality of discharges each duration of which is limited; and wherein a standardized wall charge is formed in each of the discharge cells due to the plurality of discharges so that the selective discharge is easily generated by application of data pulses during the address period.

In accordance with still yet another aspect of the present invention, the present invention provides an Alternating Current (AC) Plasma Display Panel (PDP) including a plurality of discharge cells each of which has a scan electrode, a sustain electrode and an address electrode by applying drive signals to said electrodes, in which, in order to display image information on the AC PDP, one frame of the image information is divided into a plurality of sub-frames and each of the sub-frames includes a reset period, an address period and a sustain period, the AC plasma display panel further comprising: means for accumulating wall charge in the discharge cells during the reset period; means for erasing at least a part of the accumulated wall charge, during the reset period, by successively generating a plurality of discharges each duration of which is limited, so that stable data write operation is performed during the address period; and means for addressing at least a part of said discharge cells by applying data pulses to at least a part of said electrodes to enable selective discharge of said discharge cells according to said image information during the address period.

In accordance with still yet another aspect of the present invention, the present invention also provides an Alternating Current (AC) Plasma Display Panel (PDP) including a plurality of discharge cells each of which has a scan electrode, a sustain electrode and an address electrode by applying drive signals to said electrodes, in which, in order to display image information on the AC PDP, one frame of the image information is divided into a plurality of sub-frames and each of the sub-frames includes a reset period, an address period and a sustain period, the AC plasma display panel further comprising: means for accumulating wall charge in the discharge cells, in the reset period, by successively generating a plurality of discharges each duration of which is limited, so that stable data write operation is performed in the address period; means for erasing at least a part of the accumulated wall charge during the reset period; and means for addressing at least a part of said discharge cells by applying data pulses to at least a part of said electrodes to enable selective discharge of said discharge cells according to said image information during the address period.

Preferably, the magnitude of the wall charge is controlled by controlling the heights, and/or widths and/or periods of the short pulses.

Preferably, each of the discharges due to the short pulses is generated during the duration time of each of the short pulses and turned off by falling of the each of the short pulses so that the wall charge is accumulated in the discharge cells.

Preferably, each of the discharges due to the short pulses is generated during the interval of each of the short pulses and turned off by rising of the each of the short pulses so that at least a part of wall charge is erased in the discharge cells.

Preferably, the short pulses are applied to the scan electrodes of the AC PDP.

Preferably, the drive signal during the reset period includes a plurality of short pulses superposed upon a bias voltage increasing or decreasing with time.

Preferably, the drive signal in the reset period includes a plurality of short pulses superposed upon a staircase waveform increasing or decreasing with time.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
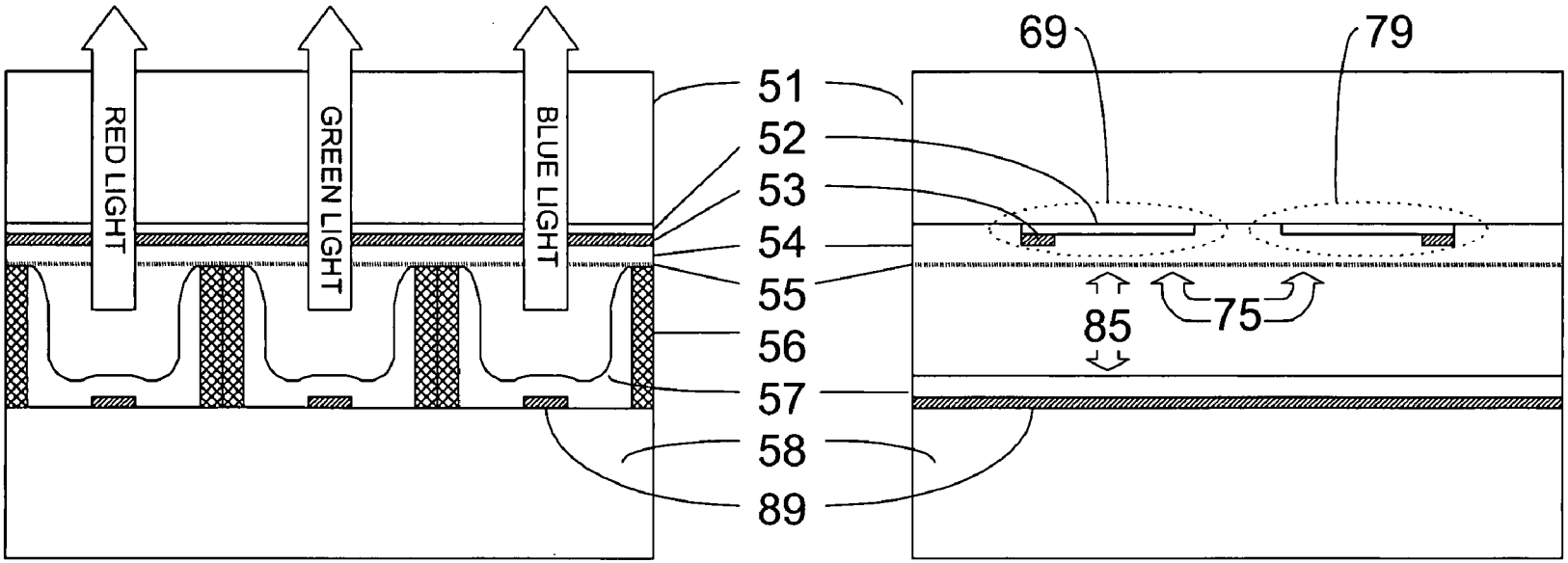
FIG. 1 PRIOR ART
FIG. 1 is a diagram showing the structure and electrode arrangement of an AC PDP that is applied to the present invention.
Figure 2:
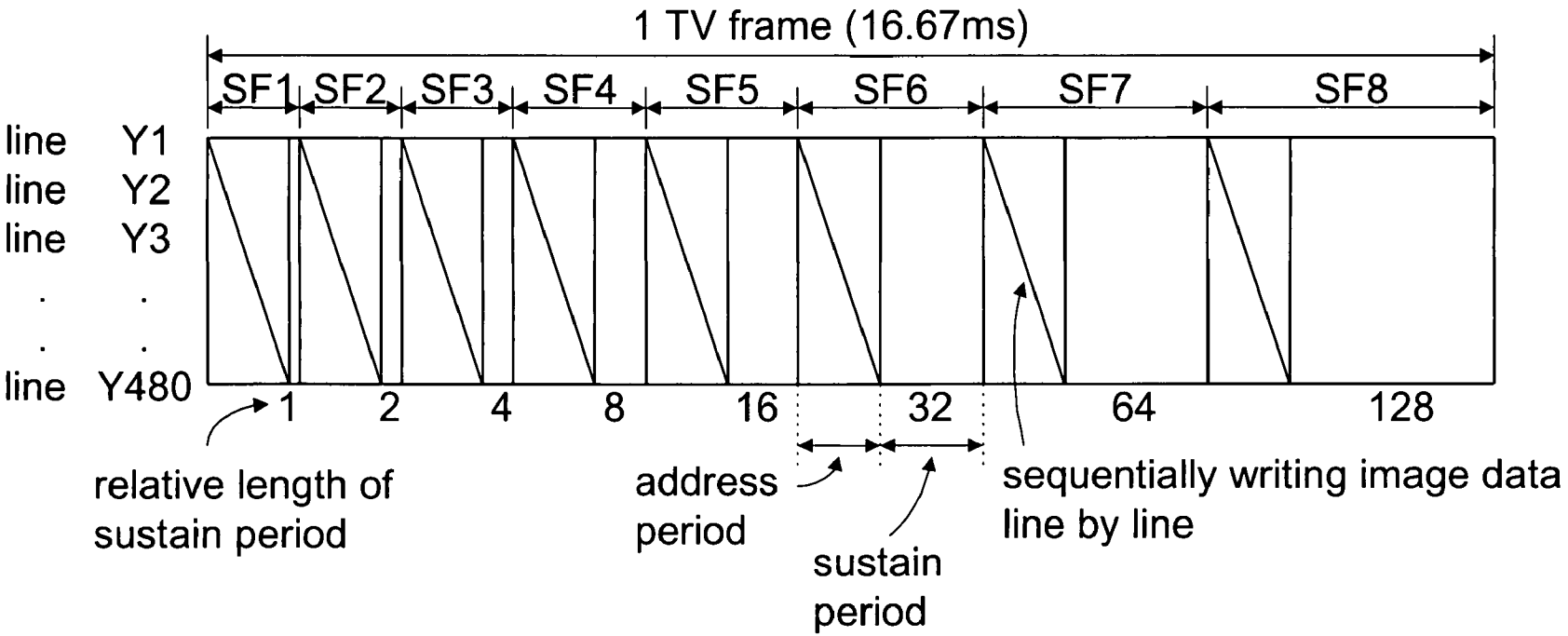
FIG. 2 PRIOR ART
FIG. 2 is a diagram showing a conventional method for driving the AC PDP while dividing a single image frame into 8 sub-fields to implement 256 gray scale levels.

Reference now should be made to the drawings, in which the same reference numerals are used throughout the different drawings to designate the same or similar components.

Figure 5:
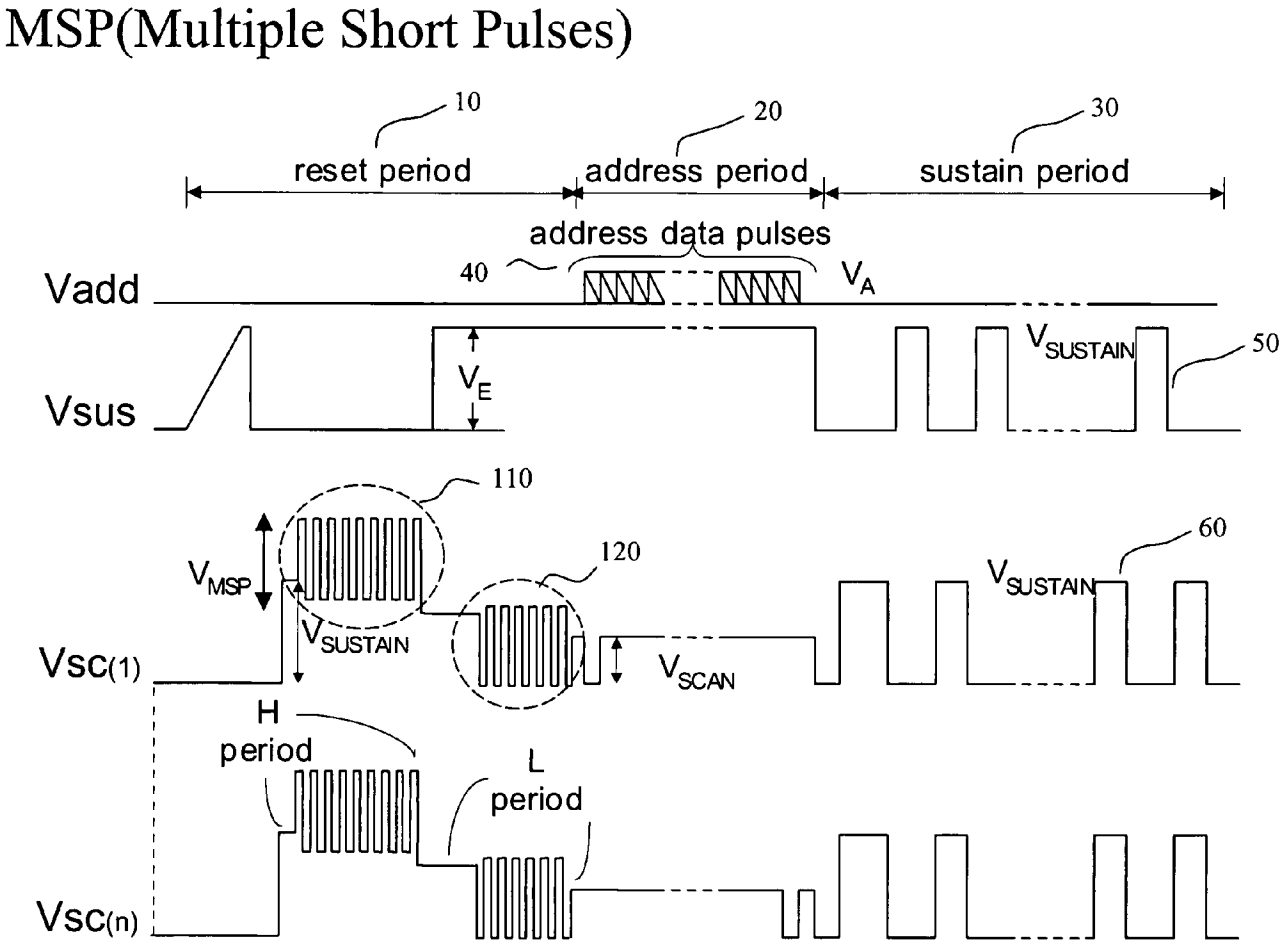
FIG. 5 is a waveform chart showing a preferred embodiment of the present invention using multiple short pulses during the reset period in a single sub-field.

FIG. 5 is a driving waveform chart showing a preferred embodiment of the present invention using Multiple Short Pulses (MSP) during the reset period in a single sub-field.

In the preferred embodiment, a single sub-field consists of a reset period 10, an address period 20 and a sustain period 30. In the reset period 10, a write operation H to all of the discharge cells in the AC PDP is performed by accumulating sufficient wall charges, and an erase operation L is performed for leaving wall charge of a desired level to assure a subsequent data write operation during the address period 20 to be easily performed. While the voltages of the sustain electrodes are maintained at a reference voltage (for example, 0V but it can be higher voltage or even floated to reduce the background light emission during H period), driving signals 110 as shown in FIG. 5 are applied to the scan electrodes for the write operation H. After that, for the erase operation L, driving signals 120 as shown in FIG. 5 are applied to the scan electrodes, while the sustain electrodes are maintained at a predetermined voltage $V_E$. The driving signals 110 for the write operation H and the driving signals 120 for the erase operation L include the multiple short pulses.

Figure 8:
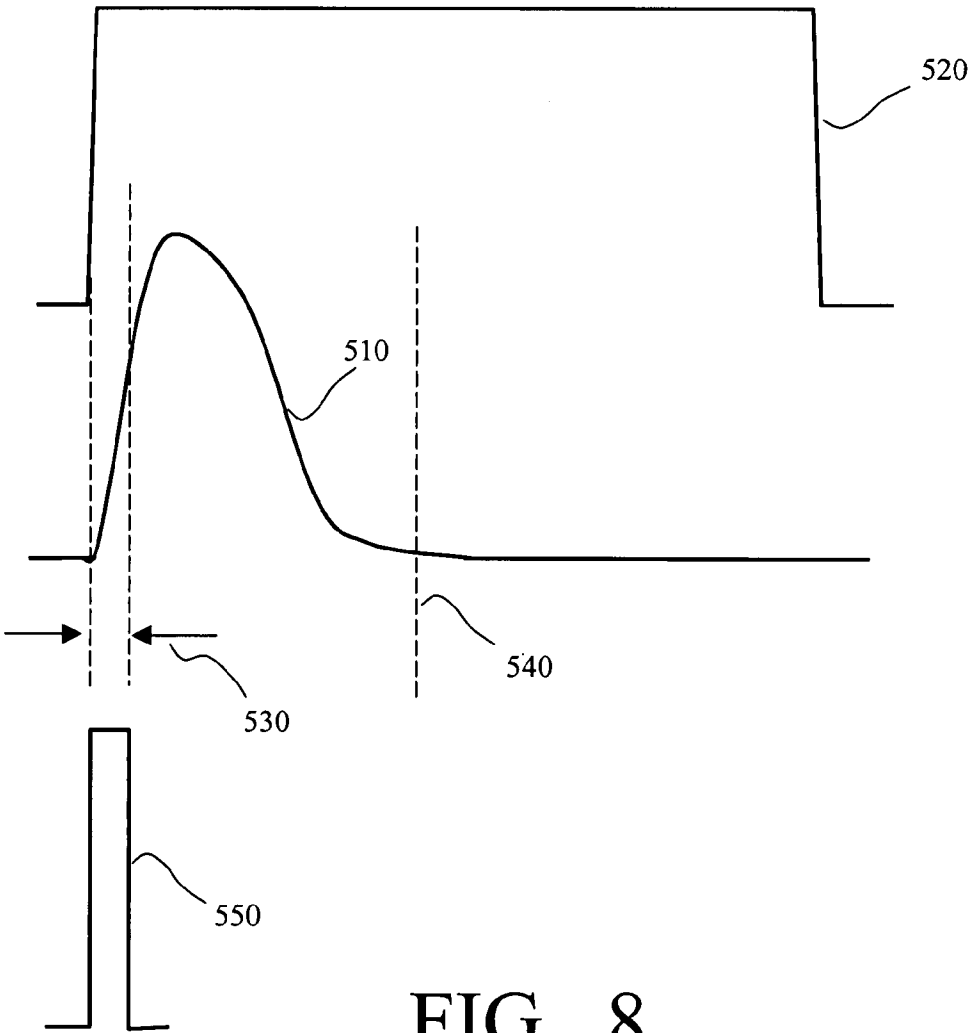
FIG. 8 is a diagram for explaining the effect of the short pulses of the present invention in comparison with conventional long pulse, by showing discharge current through the sustain electrode during the long pulse is applied.

FIG. 8 is a diagram for explaining the effect of the short pulses of the present invention in comparison with conventional long pulse 520, by showing discharge current 510 through the sustain electrode during the long pulse 520 is applied. As shown in FIG. 8, in case that the common voltage pulse 520 having a long enough width (above a few microseconds) is applied to the electrode, the discharge current 510 continuously increases and arrives its maximum level after a certain time (about 1 microsecond, generally). When the wall voltage due to the wall charge, which is accumulated in the discharge cell by the discharge, grows large enough to cancel the externally applied pulse voltage 520, the electric field in the discharge cell becomes too weak to maintain the discharge, and therefore the discharge is turned off 540 and the discharge current ceases to flow. However, a short pulse 550 having a width of a few hundreds nanoseconds is used in the reset period instead of the common long pulse 520, the discharge is turned off before the discharge current grows large, so that the duration of discharge is limited to its low luminance level 530. Thus, the unnecessary background emission during the reset period can be avoided by using the short pulse 550. In addition, sufficient wall charge can be accumulated in the discharge cell by applying the short pulse 550 repeatedly. Preferably, the width of short pulse used in the present embodiment is below 700 nanoseconds (more preferably, below 500 nanoseconds) to decrease unnecessary light emission in the reset period and therefore achieve low background luminance.

Figure 9:
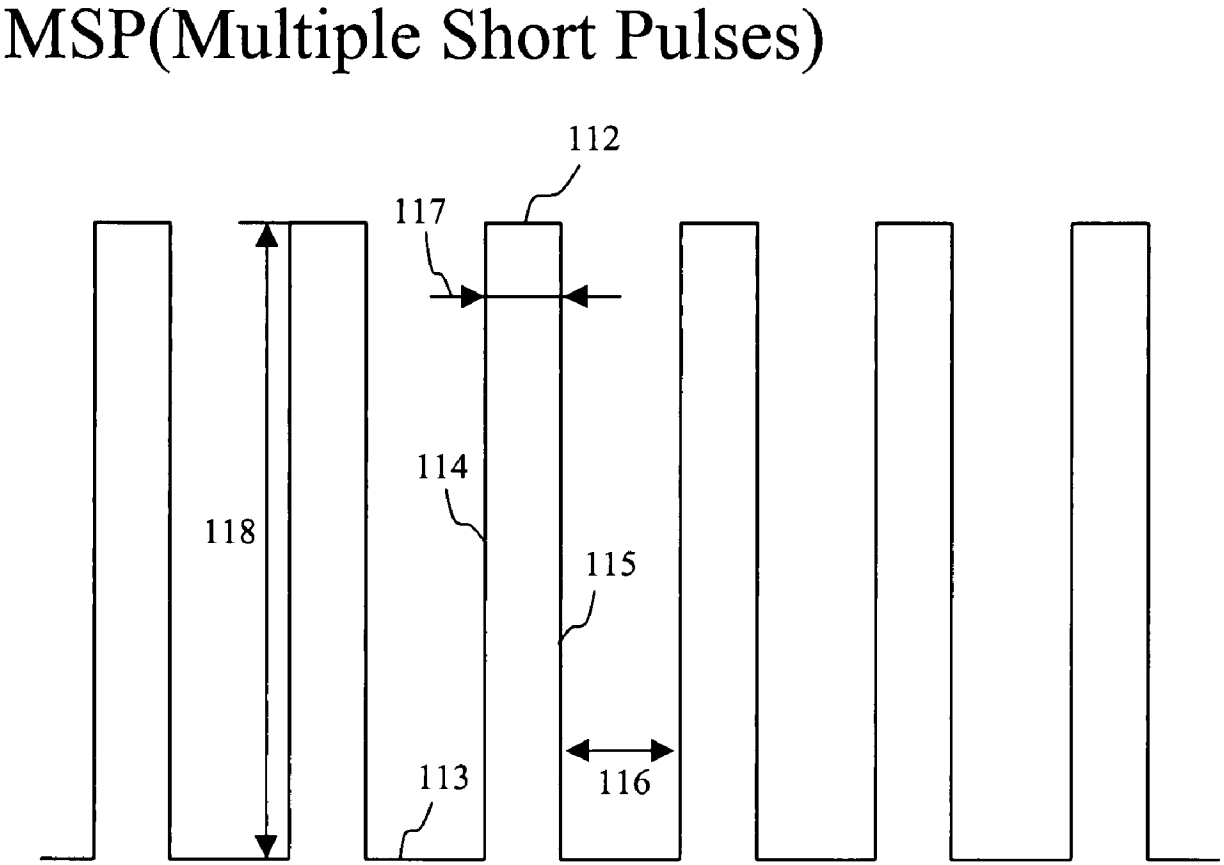
FIG. 9 is a waveform chart showing an example of the multiple short pulses, which can be used during the reset period of the present invention.

FIG. 9 is a waveform chart showing an example of the Multiple Short Pulses (MSP), which can be used during the reset period of the present embodiment. Each pulse of the MSP has a rising edge 114 where voltage rapidly increases by a rising voltage 118 and a falling edge 115. A width 117, an interval 116, a top 112 and a bottom 113 of the pulse are defined as shown in FIG. 9.

Figure 12:
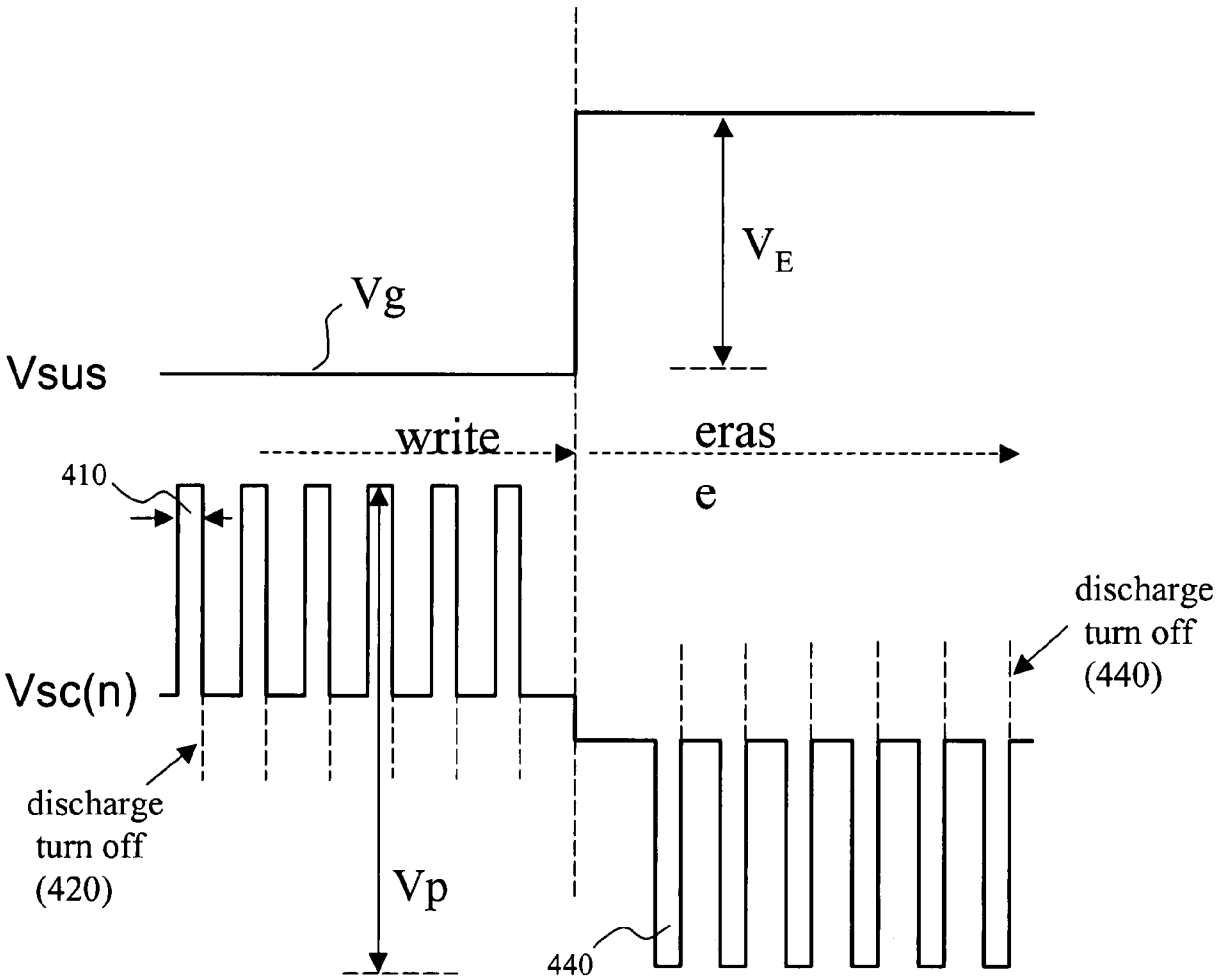
FIG. 12 is a diagram for explaining write and erase operations during a reset period of a driving method of the present invention.
Figure 13:
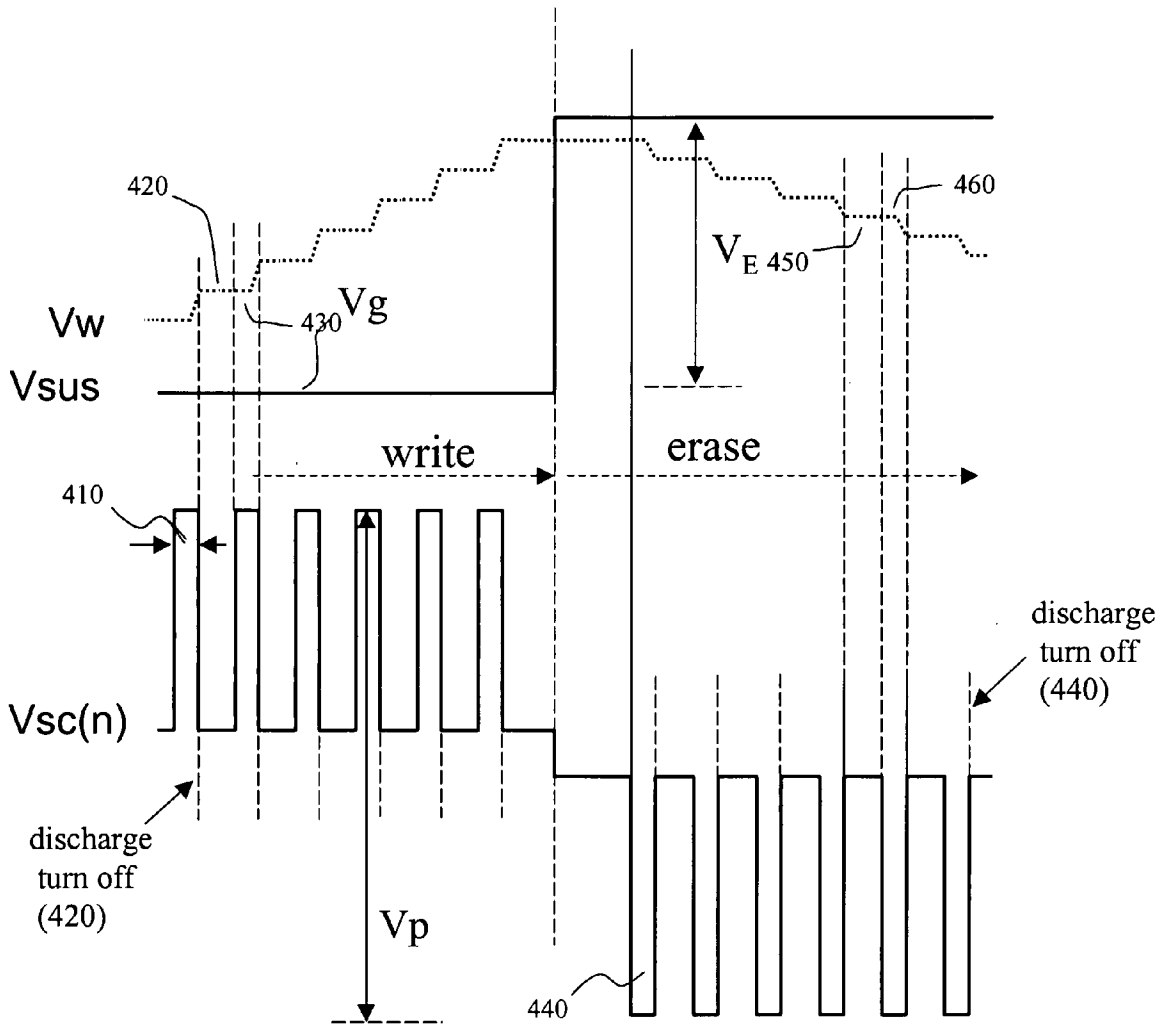
FIG. 13 is a diagram for explaining the variation of wall charge during the write and erase operations during a reset period of a driving method of the present invention.

FIG. 12 is a diagram for explaining the write and erase operations during the reset period of the driving method of the present embodiment. And, FIG. 13 is a diagram for explaining the variation of wall charge during the write and erase operations. As shown in FIG. 12, the sustain electrode voltage Vsus is maintained at the reference voltage Vg, while the driving signal Vsc including the multiple short pulses is applied to the scan electrode. By using the multiple short pulses, discharges can be controlled to be generated during the duration 410 of the pulse and turned off behind the falling edge 115 of the pulse. As shown in FIG. 12, because the short pulse is applied repeatedly, the discharges are formed repeatedly. Each duration of the discharges by the multiple short pulses are limited such that the discharge current remains at a low level. Thus, sufficient amount of wall charge accumulation in the discharge cells can be achieved by repetition of the discharges, avoiding high luminance during the reset period.

For the erase operation following the write operation described above, the sustain electrode voltage Vsus is maintained at the predetermined voltage $V_E$, while the driving signal Vsc including the multiple short pulses is applied to the scan electrode. In this case, because the polarities of the electrodes are reversed, discharges can be controlled to be generated in the interval 440 of the pulse and turned off behind the rising edge 114 of the pulse. As shown in FIG. 12, because the short pulse is applied repeatedly, the discharges are formed repeatedly. Each duration of the discharges by the multiple short pulses are limited such that the discharge current remains at a low level. Thus, the erase operation is fulfilled by repetition of the discharges, avoiding high luminance during the reset period. As shown in FIG. 13, during the write operation stage, the wall voltage Vw increases in the duration 410 of the pulses as a result of wall charge accumulation by the discharge, while being constant voltage 420 during the interval of the pulses. On the other hand, in the erase operation stage, the wall voltage Vw decreases in the interval 440 of the pulses as a result of wall charge reduction by the discharge, while being constant voltage 450 during the duration of the pulse.

Figure 6:
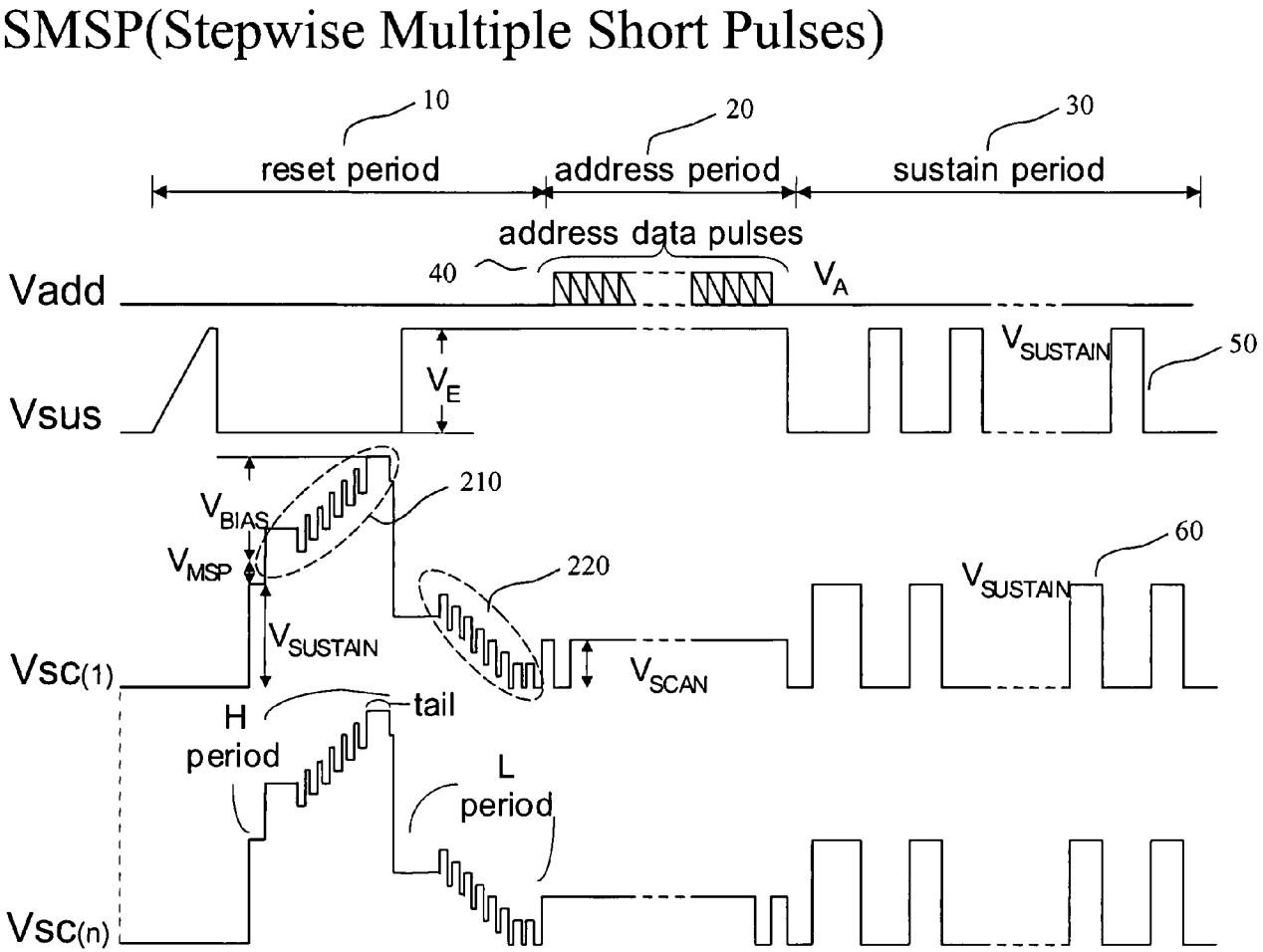
FIG. 6 is a waveform chart showing another preferred embodiment of the present invention using stepwise multiple short pulses during the reset period in a single sub-field.

FIG. 6 is a waveform chart showing another preferred embodiment of the present invention using Stepwise Multiple Short Pulses (SMSP) during the reset period in a single sub-field.

While the voltages of the sustain electrodes are maintained at a reference voltage (for example, 0V), driving signals 210 as shown in FIG. 6 are applied to the scan electrodes for the write operation H. After that, for the erase operation L, driving signals 220 as shown in FIG. 6 are applied to the scan electrodes, while the sustain electrodes are maintained at a predetermined voltage $V_E$. The driving signals 210 for the write operation H and the driving signals 220 for the erase operation L include the stepwise multiple short pulses where voltage level at the tops of the pulses increases stepwise.

Figure 10:
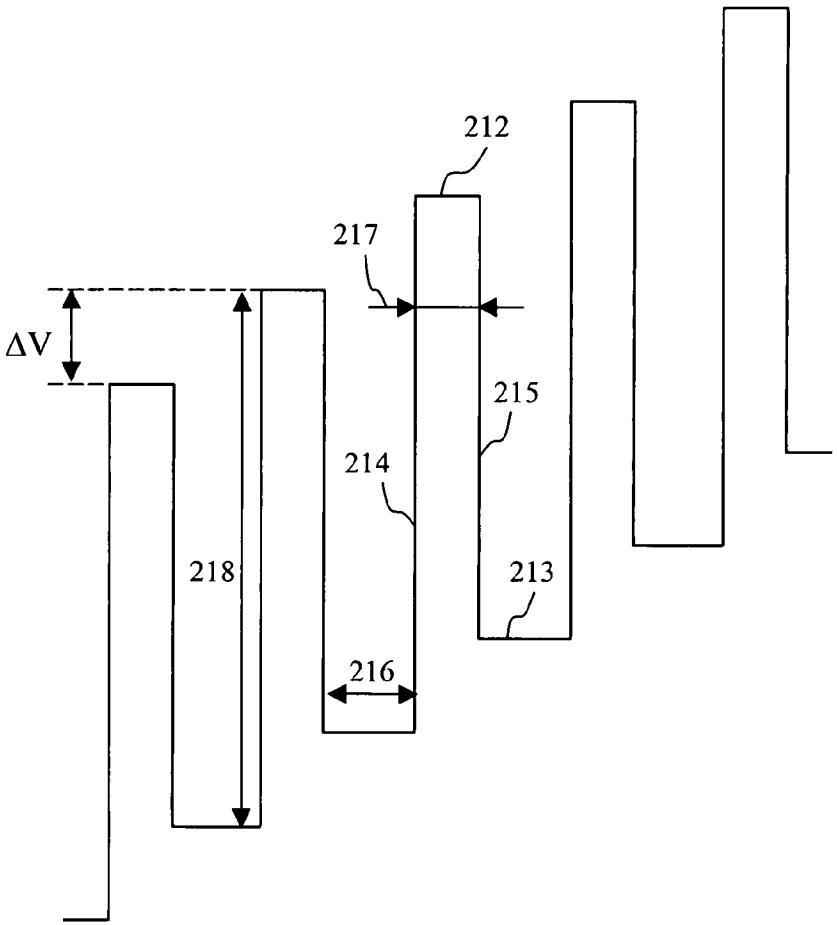
FIG. 10 is a waveform chart showing an example of the stepwise multiple short pulses, which can be used during the reset period of the present invention.

FIG. 10 is a waveform chart showing an example of the Stepwise Multiple Short Pulses (SMSP), which can be used during the reset period of the present embodiment. Each pulse of the SMSP has a rising edge 214 where voltage rapidly increases by a rising voltage 218 and a falling edge 215. The width 217, the interval 216, the top 212 and the bottom 213 of the pulse are defined as shown in FIG. 10. voltage level at the tops 212 of pulses increases stepwise in the example of FIG. 10 and during the write operation stage H of the FIG. 6. Another example of the SMSP where voltage level at the tops 212 of pulses decreases stepwise is shown during the erase operation stage L of the FIG. 6.

During the write operation stage H shown in FIG. 6, by using the stepwise multiple short pulses, discharges can be controlled to be generated repeatedly in the durations of the pulses and turned off repeatedly behind the falling edges 215 of the pulses. Each duration of the discharges by the short pulses are limited such that the discharge current remains at a low level. Thus, sufficient amount of wall charge accumulation in the discharge cells can be achieved by repetition of the discharges, avoiding high background luminance during the reset period.

During the erase operation stage L shown in FIG. 6, discharges can be controlled to be generated repeatedly in the intervals of the pulses and turned off repeatedly behind the rising edge 214 of the pulse. Each duration of the discharges by the short pulses are limited such that the discharge current remains at a low level. Thus, the erase operation is fulfilled by repetition of the discharges, avoiding high background luminance in the reset period.

Figure 7:
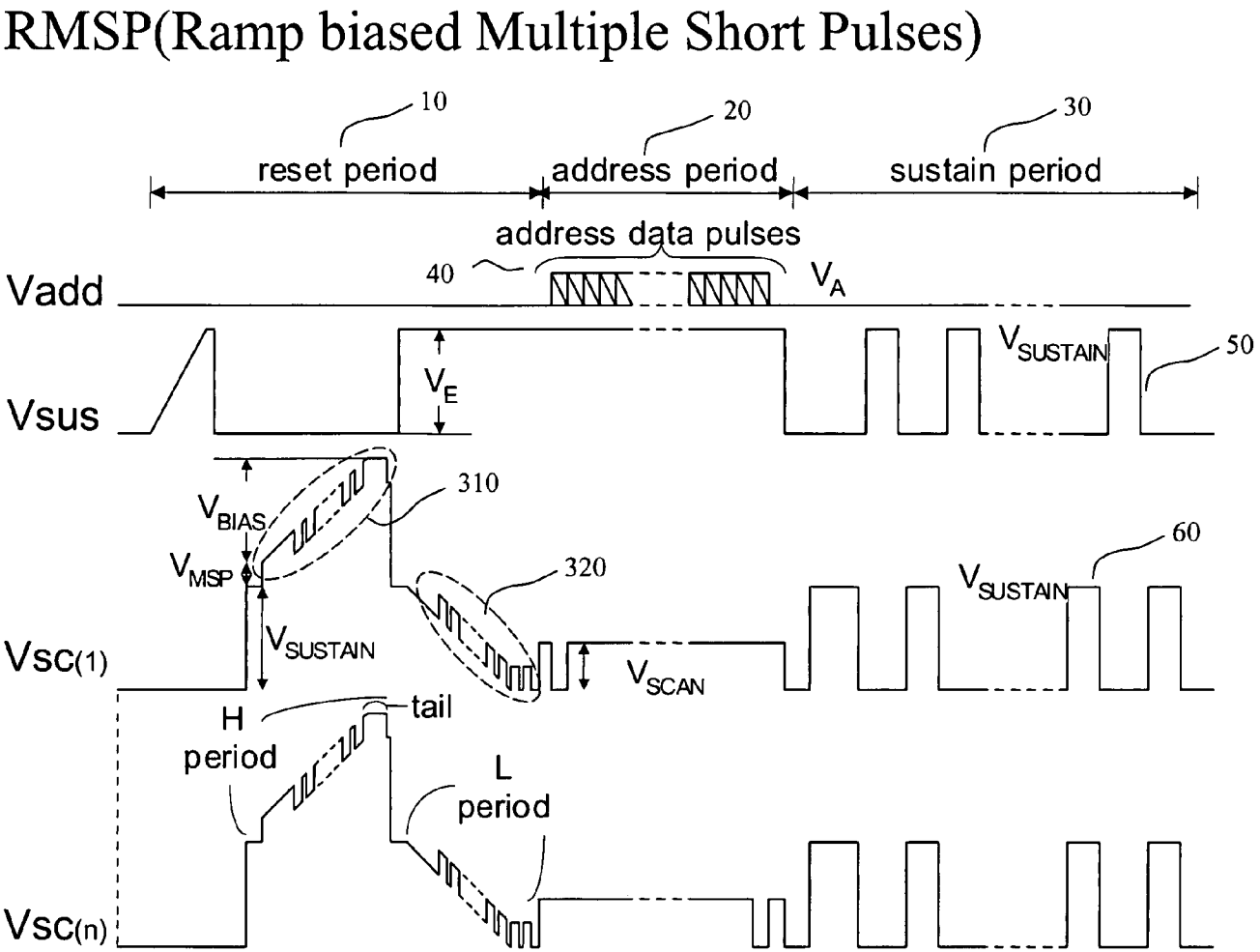
FIG. 7 is a waveform chart showing yet another preferred embodiment of the present invention using ramp-biased multiple short pulses during the reset period in a single sub-field.

FIG. 7 is a waveform chart showing another preferred embodiment of the present invention using Ramp-biased Multiple Short Pulses (RMSP) during the reset period in a single sub-field.

While the voltages of the sustain electrodes are maintained at a reference voltage (for example, 0V), driving signals 310 as shown in FIG. 7 are applied to the scan electrodes for the write operation H. After that, for the erase operation L, driving signals 320 as shown in FIG. 7 are applied to the scan electrodes, while the sustain electrodes are maintained at a predetermined voltage $V_E$. The driving signals 310 for the write operation H and the driving signals 320 for the erase operation L include the ramp-biased multiple short pulses where voltage level at the tops of the pulses increases linearly.

Figure 11:
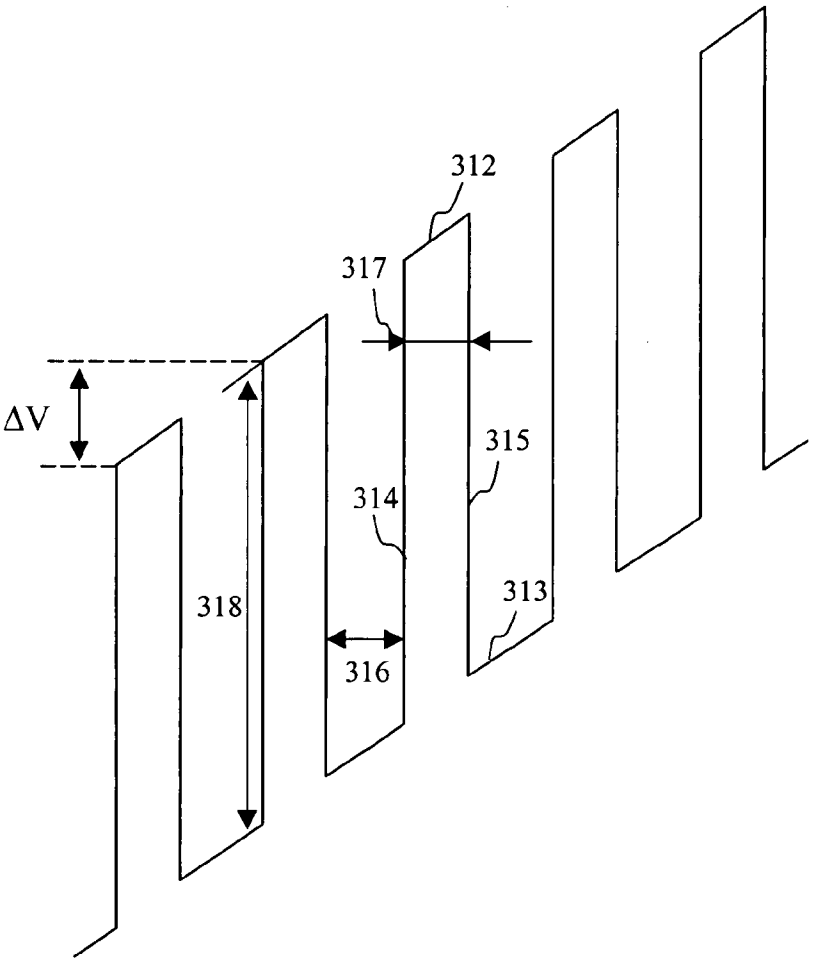
FIG. 11 is a waveform chart showing an example of the ramp-biased multiple short pulses, which can be used during the reset period of the present invention.

FIG. 11 is a waveform chart showing an example of the Ramp-biased Multiple Short Pulses (RMSP), which can be used during the reset period of the present embodiment. Each pulse of the RMSP has a rising edge 314 where voltage rapidly increases by a rising voltage 318 and a falling edge 315. The width 317, the interval 316, the top 312 and the bottom 313 of the pulse are defined as shown in FIG. 11. Voltage level at the tops 312 of pulses increases linearly in the example of FIG. 11 and during the write operation stage H of the FIG. 7. Another example of the RMSP where voltage level at the tops 312 of pulses decreases linearly is shown during the erase operation stage L of the FIG. 7.

During the write operation stage H shown in FIG. 7, by using the ramp-biased multiple short pulses, discharges can be controlled to be generated repeatedly in the durations of the pulses and turned off repeatedly behind the falling edges 315 of the pulses. Each duration of the discharges by the short pulses are limited such that the discharge current remains at a low level. Thus, sufficient amount of wall charge accumulation in the discharge cells can be achieved by repetition of the discharges, avoiding high background luminance in the reset period.

During the erase operation stage L shown in FIG. 7, discharges can be controlled to be generated repeatedly in the intervals of the pulses and turned off repeatedly behind the rising edge 314 of the pulse. Each duration of the discharges by the short pulses are limited such that the discharge current remains at a low level. Thus, the erase operation is fulfilled by repetition of the discharges, avoiding high background luminance in the reset period.

During the reset operations using various kinds of the multiple short pulses explained above, rising voltages 118, 218 and 318, widths 117, 217 and 317, and intervals 116, 216 and 316 of pulses can be adjusted independently. Therefore, the amount of wall charges during the reset period, necessary length of the reset period, and level of the background luminance can be controlled to meet the desired specification of a display device.

In the above mentioned preferred embodiments using the multiple short pulses as shown in FIG. 13, the stepwise multiple short pulses as shown in FIG. 10 and the ramp-biased multiple short pulses as shown in FIG. 11, repeated discharges each duration of which is limited by rapid turn-off are generated. That is one of main aspects of the present invention.

During the reset operation using the stepwise multiple short pulses of FIG. 10 or the ramp-biased multiple short pulses of FIG. 11, not only rising voltages 118, 218 and 318, widths 117, 217 and 317, and intervals 116, 216 and 316 of pulses but also voltage difference $\Delta V$ can be adjusted independently. Therefore, the amount of wall charges during the reset period, necessary length of the reset period, and level of the background luminance can be controlled to meet the desired specification of a display device.

Figure 14:
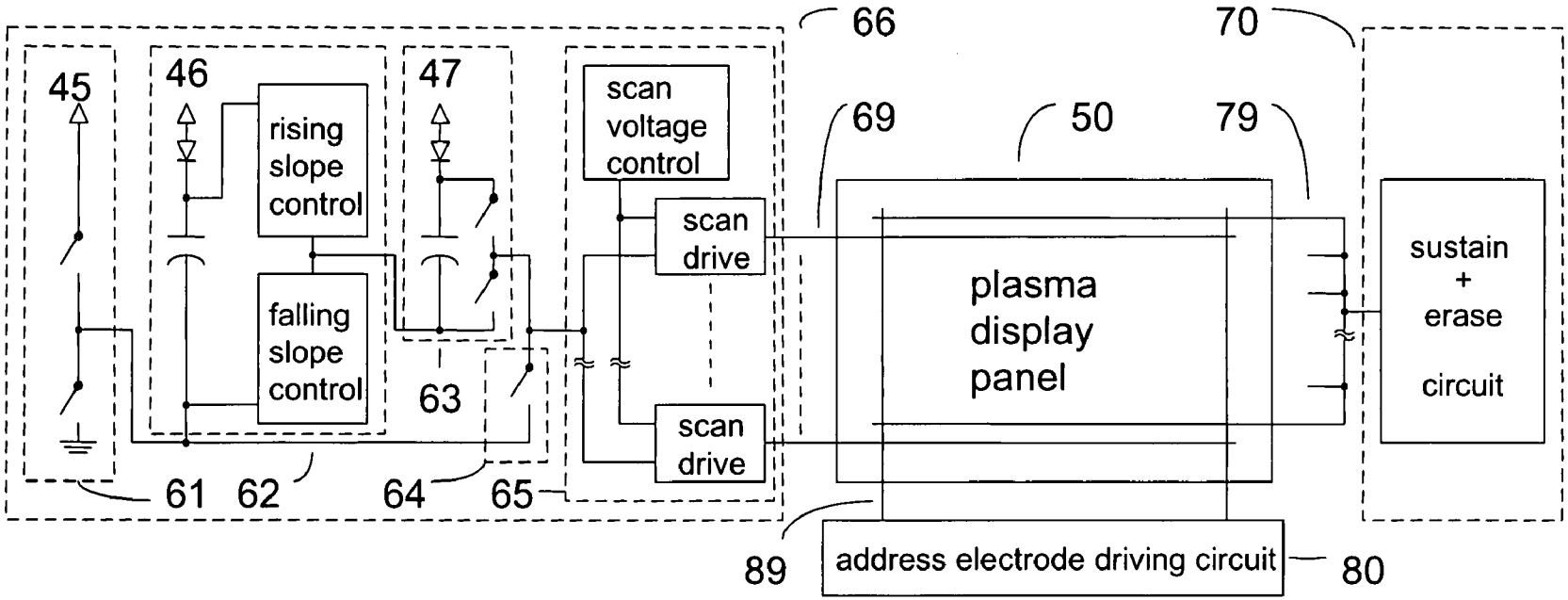
FIG. 14 is a diagram showing an example of a system for driving the AC PDP, including a short pulse providing circuit for controlling and outputting the pulses of a reset period, in accordance with the embodiment of the present invention shown in FIG. 7.

FIG. 14 is a diagram showing an example of a system for driving the AC PDP, including a short pulse providing circuit for controlling and outputting the pulses of a reset period, in accordance with the embodiment of the present invention shown in FIG. 7.

A scan electrode driving circuit 60 can comprise a sustain circuit 61, a bias voltage applying circuit 62, a short pulse applying circuit 63, a circuit 64 for connecting the sustain circuit 61 and the other elements, and a scan driving circuit 65 for applying progressive scanning on the scan electrodes 69 in the address period. The scan electrode driving circuit 60 requires a sustain voltage 45, a bias voltage 46 and a short pulse voltage 47. The address electrode driving circuit 80 can apply data pulses to the address electrodes 89, and the sustain electrode driving circuit 70 can apply sustain and erase pulses to the sustain electrodes 79.

Figure 3:
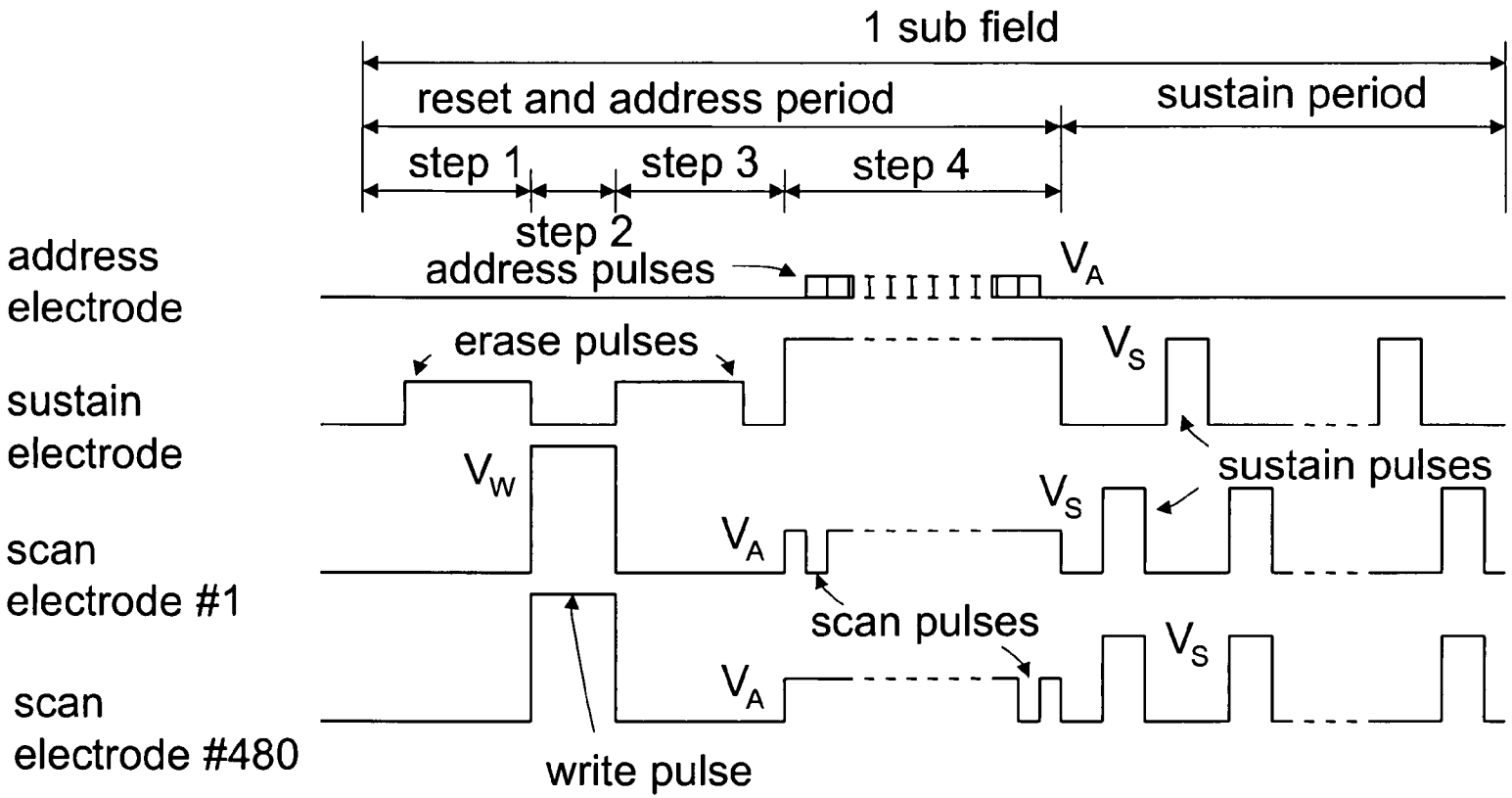
FIG. 3 PRIOR ART
FIG. 3 is a waveform chart showing a conventional reset method using strong pulse reset waveforms in a single sub-field.
Figure 4:
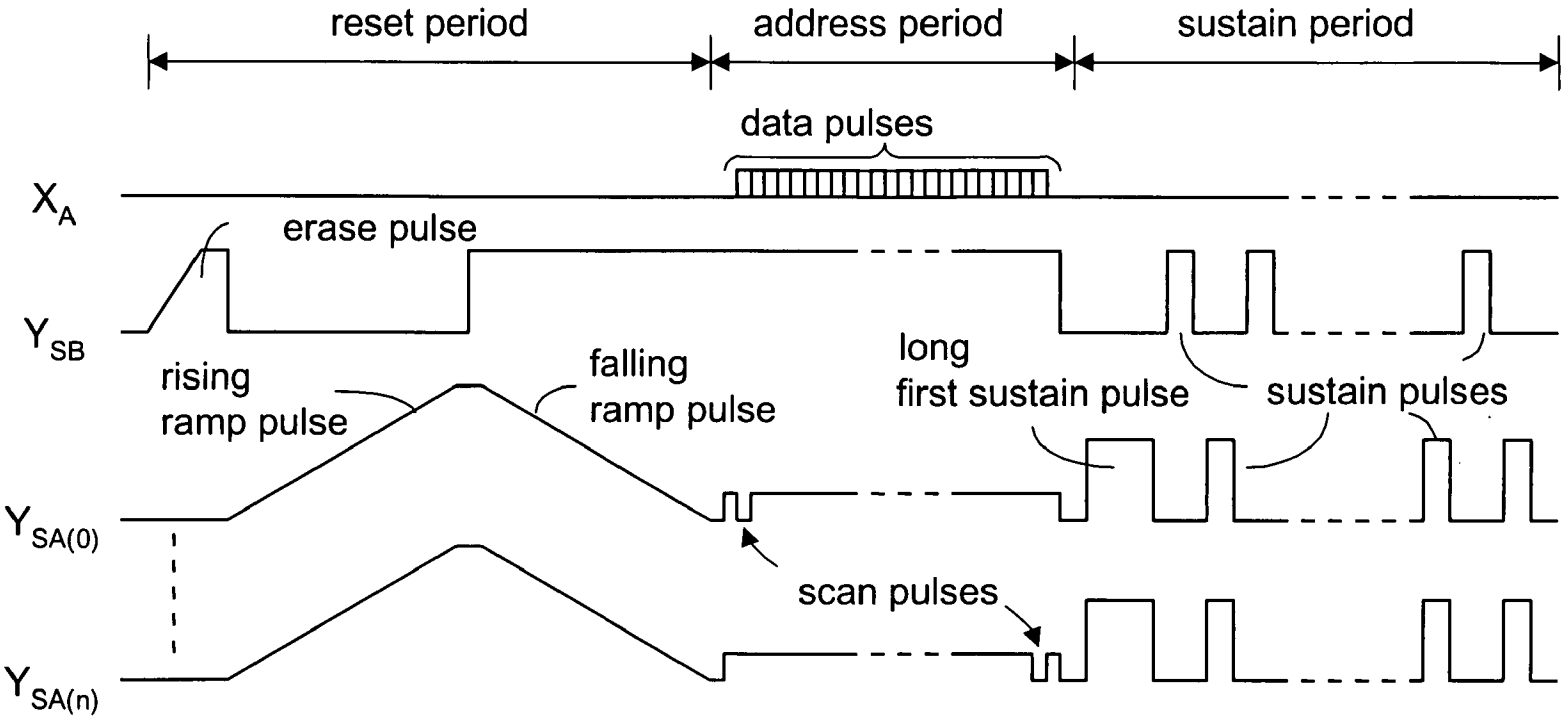
FIG. 4 PRIOR ART
FIG. 4 is a waveform chart showing another conventional reset method using ramp waveforms in a single sub-field.

Although the specified embodiments have been disclosed above, various modifications are possible without departing from the scope and spirit of the invention. For example, a log waveform or any waveform having a voltage pattern increasing with time can be provided as the bias voltage, differently from the above-described embodiment in which a bias voltage increases linearly as shown in FIG. 7. Various modifications, where short pulses may be applied only during some intervals and another type of voltages such as conventional long pulses shown in FIG. 3 and ramp voltages shown in FIG. 4 may be applied in the remaining intervals, or a pause interval may be provided between several pulses and another several pulses, can be made. As long as all cases, including the above-described modifications, imply the spirit of the invention to improve the performance of a reset operation by repeatedly generating a plurality of discharges each duration of which is limited, the cases fall within the scope of the present invention.

By employing the method and apparatus for driving an AC PDP, it is possible to overcome disadvantages of conventional reset methods for AC PDPs in which stability is insufficient, background luminance is high and a long reset time is required, so that background luminance can be reduced and the time required for a reset period can be shortened while stability and an address margin are sufficiently maintained, thus improving reset performance.

Further, by the present invention, it is possible to provide a method and apparatus for driving an AC PDP, where a reset operation is fulfilled by successively generating short discharges each duration of which is limited, so that each of the discharge is rapidly turned off before discharge current and light emission grow large, that is, in its initial stage, thus reducing the background luminance, shortening the reset time and providing the sufficient stability of driving.

Further, by the present invention, it is possible to provide a method and apparatus for driving an AC PDP, where a reset operation is fulfilled by using a drive signal including a plurality of successive short pulses to generate a plurality of discharges each duration of which is limited, wherein the heights, widths and periods of the short pulses are controllable, so that amount of wall charge in the discharge cell is controllable and desired levels and uniform distribution of wall charges over the AC PDP can be obtained.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of driving an Alternating Current (AC) Plasma Display Panel (PDP) including a plurality of discharge cells each of which has a scan electrode, a sustain electrode and an address electrode by applying drive signals to said electrodes, in which, in order to display image information on the AC PDP, one frame of the image information is divided into a plurality of sub-frames and each of the sub-frames includes a reset period, an address period and a sustain period, comprising the steps of:

applying a drive signal including a plurality of successive short pulses in the reset period;

addressing at least a part of said discharge cells by applying data pulses to at least a part of said electrodes to enable selective discharge of said discharge cells according to said image information in the address period;

wherein, during the reset period, said plurality of short pulses form a plurality of discharges each duration of which is limited; and wherein a standardized wall charge is formed in each of the discharge cells due to the plurality of discharges so that the selective discharge is easily generated by application of data pulses during the address period.

2. The method as set forth in claim 1, wherein the magnitude of the wall charge is controlled by controlling the heights, and/or widths and/or periods of the short pulses.

3. The method as set forth in claim 1, wherein each of the discharges due to the short pulses is generated in the duration time of each of the short pulses and turned off by falling of the each of the short pulses so that the wall charge is accumulated in the discharge cells.

4. The method as set forth in claim 1, wherein each of the discharges due to the short pulses is generated in the interval of each of the short pulses and turned off by rising of the each of the short pulses so that at least a part of wall charge is erased in the discharge cells.

5. The method as set forth in claim 1, wherein the short pulses are applied to the scan electrodes of the AC PDP.

6. The method as set forth in claim 1, wherein, the drive signal during the reset period includes a plurality of short pulses superposed upon a bias voltage increasing or decreasing with time.

7. The method as set forth in claim 1, wherein, the drive signal during the reset period includes a plurality of short pulses superposed upon a staircase waveform increasing or decreasing with time.

8. A method of driving an Alternating Current (AC) Plasma Display Panel (PDP) including a plurality of discharge cells each of which has a scan electrode, a sustain electrode and an address electrode by applying drive signals to said electrodes, in which, in order to display image information on the AC PDP, one frame of the image information is divided into a plurality of sub-frames and each of the sub-frames includes a reset period, an address period and a sustain period, comprising the steps of:

accumulating wall charge in the discharge cells during the reset period;

erasing at least a part of the accumulated wall charge, during the reset period, by successively generating a plurality of discharges each duration of which is limited, so that stable data write operation is performed in the address period; and addressing at least a part of said discharge cells by applying data pulses to at least a part of said electrodes to enable selective discharge of said discharge cells according to said image information in the address period.

9. A method of driving an Alternating Current (AC) Plasma Display Panel (PDP) including a plurality of discharge cells each of which has a scan electrode, a sustain electrode and an address electrode by applying drive signals to said electrodes, in which, in order to display image information on the AC PDP, one frame of the image information is divided into a plurality of sub-frames and each of the sub-frames includes a reset period, an address period and a sustain period, comprising the steps of:

accumulating wall charge in the discharge cells, during the reset period, by successively generating a plurality of discharges each duration of which is limited, so that stable data write operation is performed during the address period;

erasing at least a part of the accumulated wall charge during the reset period; and addressing at least a part of said discharge cells by applying data pulses to at least a part of said electrodes to enable selective discharge of said discharge cells according to said image information during the address period.

10. An Alternating Current (AC) Plasma Display Panel (PDP) including a plurality of discharge cells each of which has a scan electrode, a sustain electrode and an address electrode by applying drive signals to said electrodes, in which, in order to display image information on the AC PDP, one frame of the image information is divided into a plurality of sub-frames and each of the sub-frames includes a reset period, an address period and a sustain period, the AC plasma display panel further comprising:

means for applying a drive signal including a plurality of successive short pulses during the reset period;

means for addressing at least a part of said discharge cells by applying data pulses to at least a part of said electrodes to enable selective discharge of said discharge cells according to said image information during the address period;

wherein, during the reset period, said plurality of short pulses form a plurality of discharges each duration of which is limited; and wherein a standardized wall charge is formed in each of the discharge cells due to the plurality of discharges so that the selective discharge is easily generated by application of data pulses during the address period.

11. The AC plasma display panel as set forth in claim 10, wherein a magnitude of the wall charge is controlled by controlling the heights, and/or widths and/or periods of the short pulses.

12. The AC plasma display panel as set forth in claim 10, wherein each of the discharges due to the short pulses is generated in the duration time of each of the short pulses and turned off by falling of the each of the short pulses so that the wall charge is accumulated in the discharge cells.

13. The AC plasma display panel as set forth in claim 10, wherein each of the discharges due to the short pulses is generated in the interval of each of the short pulses and turned off by rising of the each of the short pulses so that at least a part of wall charge is erased in the discharge cells.

14. The AC plasma display panel as set forth in claim 10, wherein the short pulses are applied to the scan electrodes of the AC PDP.

15. The AC plasma display panel as set forth in claim 10, wherein, the drive signal during the reset period includes a plurality of short pulses superposed upon a bias voltage increasing or decreasing with time.

16. The AC plasma display panel as set forth in claim 10, wherein, the drive signal during the reset period includes a plurality of short pulses superposed upon a staircase waveform increasing or decreasing with time.

17. An Alternating Current (AC) Plasma Display Panel (PDP) including a plurality of discharge cells each of which has a scan electrode, a sustain electrode and an address electrode by applying drive signals to said electrodes, in which, in order to display image information on the AC PDP, one frame of the image information is divided into a plurality of sub-frames and each of the sub-frames includes a reset period, an address period and a sustain period, the AC plasma display panel further comprising:

means for accumulating wall charge in the discharge cells during the reset period;

means for erasing at least a part of the accumulated wall charge, during the reset period, by successively generating a plurality of discharges each duration of which is limited, so that stable data write operation is performed during the address period; and means for addressing at least a part of said discharge cells by applying data pulses to at least a part of said electrodes to enable selective discharge of said discharge cells according to said image information during the address period.

18. An Alternating Current (AC) Plasma Display Panel (PDP) including a plurality of discharge cells each of which has a scan electrode, a sustain electrode and an address electrode by applying drive signals to said electrodes, in which, in order to display image information on the AC PDP, one frame of the image information is divided into a plurality of sub-frames and each of the sub-frames includes a reset period, an address period and a sustain period, the AC plasma display panel further comprising:

means for accumulating wall charge in the discharge cells, during the reset period, by successively generating a plurality of discharges each duration of which is limited, so that stable data write operation is performed during the address period;

means for erasing at least a part of the accumulated wall charge during the reset period; and means for addressing at least a part of said discharge cells by applying data pulses to at least a part of said electrodes to enable selective discharge of said discharge cells according to said image information during the address period.

* * * * *